US010428566B2

(12) United States Patent
Arendts

(10) Patent No.: US 10,428,566 B2
(45) Date of Patent: Oct. 1, 2019

(54) FLEXIBLE UNITARY SANDWICH-LIKE PANEL OVERHEAD DOOR

(71) Applicant: James G. Arendts, Thayne, WY (US)

(72) Inventor: James G. Arendts, Thayne, WY (US)

( * ) Notice: Subject to any disclaimer, the term of this patent is extended or adjusted under 35 U.S.C. 154(b) by 64 days.

(21) Appl. No.: 15/489,104

(22) Filed: Apr. 17, 2017

(65) Prior Publication Data

US 2018/0298660 A1 Oct. 18, 2018

(51) Int. Cl.

| | |
|---|---|
| ***E06B 9/58*** | (2006.01) |
| ***E05D 15/22*** | (2006.01) |
| ***E06B 3/70*** | (2006.01) |
| ***E06B 9/13*** | (2006.01) |
| *E05D 15/16* | (2006.01) |
| *E06B 9/15* | (2006.01) |

(52) U.S. Cl.

CPC ..... *E05D 15/22* (2013.01); *E06B 3/7015* (2013.01); *E06B 9/13* (2013.01); *E06B 9/581* (2013.01); *E05D 15/165* (2013.01); *E05D 2015/225* (2013.01); *E05Y 2900/106* (2013.01); *E06B 2003/7044* (2013.01); *E06B 2003/7046* (2013.01); *E06B 2003/7049* (2013.01); *E06B 2009/1516* (2013.01)

(58) Field of Classification Search

CPC .. E06B 9/04; E06B 2009/2435; E06B 9/0692; E06B 2009/2423; E06B 9/58; E06B 9/262; E06B 9/13; E06B 2009/2458; E06B 3/7015; E06B 2003/7044; E06B 2003/7046; E06B 2003/7049; E06B 2003/7051; E06B 3/80; E06B 2003/7053; E06B 3/44; E06B 3/46; E06B 3/4407; E05D 15/36; E05D 15/38; E05D 15/165; E05D 2015/225

See application file for complete search history.

(56) References Cited

U.S. PATENT DOCUMENTS

| | | | | |
|---|---|---|---|---|
| 4,313,422 A * | 2/1982 | McEntee | F24S 23/745 | 126/624 |
| 4,625,786 A * | 12/1986 | Carter | E06B 9/262 | 160/268.1 |
| 5,392,832 A * | 2/1995 | Colson | E06B 9/262 | 160/168.1 R |
| 5,739,161 A * | 4/1998 | Ueno | A61K 31/5575 | 514/530 |
| 9,909,358 B2 * | 3/2018 | Ungs | E06B 9/13 | |
| 2003/0127198 A1 * | 7/2003 | Court | B60J 5/14 | 160/231.1 |
| 2007/0193698 A1 * | 8/2007 | Kraeutler | E06B 9/063 | 160/36 |
| 2013/0042983 A1 * | 2/2013 | Wachtell | E05B 81/10 | 160/327 |

* cited by examiner

*Primary Examiner* — Katherine W Mitchell
*Assistant Examiner* — Jeremy C Ramsey

(57) ABSTRACT

A flexible unitary sandwich-like panel overhead door (11) consists of two relatively thin elastic sheets (12) and (13) connected by a plurality of elongated parallel web panels (14) which have supporting rollers (16) attached. The sheet-web connections are hinged (15) so that the panel may be flexibly moved from a closed vertical position to an open overhead nearly horizontal configuration. A rectangular beam (17), attached to the elastic sheets, provides additional stability and strength to the door structure. Additional embodiments are described.

16 Claims, 14 Drawing Sheets

FLEXIBLE UNITARY SANDWICH-LIKE PANEL OVERHEAD DOOR

PRIOR ART—REFERENCES

The following is a tabulation of some prior art that presently appears relevant:

U.S. Patents

| Pat. No. | Kind Code | Issue Date | Patentee |
|---|---|---|---|
| 4,294,055 | | 1981 Oct. 13 | Andresen |
| 4,452,293 | | 1984 Jun. 5 | Gorse |
| 4,460,030 | | 1984 Jul. 17 | Tsunemura et al. |
| 4,545,417 | | 1985 Oct. 8 | Todd |
| 5,555,923 | | 1996 Sep. 17 | Leist et al. |
| 6,883,577 | B2 | 2005 Apr. 26 | Frede |
| 7,231,953 | B2 | 2007 Jun. 19 | Varley et al. |

U.S. Patent Application Publications

| Publication Nr. | Kind Code | Pub. Date | Applicant |
|---|---|---|---|
| 20030173040 | A1 | 2003 Sep. 18 | Court et al. |
| 20040099382 | A1 | 2004 May 27 | Mullet et al. |
| 20100132894 | A1 | 2010 Jun. 3 | Knutson et al. |

U.S. Patent Application Publications

| Publication Nr. | Kind Code | Pub. Date | Applicant |
|---|---|---|---|
| 20110265959 | A1 | 2011 Nov. 3 | Frede |
| 20120318468 | A1 | 2012 Dec. 20 | Szczgielki |
| 20150376933 | A1 | 2015 Dec. 31 | Schweiss |
| 20160024837 | A1 | 2016 Jan. 28 | Wachtell et al. |

Nonpatent Literature Documents

Arendts, J. G., "Load Distribution in Simply Supported Concrete Box Girder Highway Bridges," thesis presented to the Iowa State University, at Ames, Iowa, in 1969, in partial fulfillment of the requirements for the degree of Doctor of Philosophy, http://lib.dr.iastate.edu/rtd, paper 3623.

Arendts, J. G. and Sanders, W. W., Jr., "Concrete Box-Girder Bridges as Sandwich Plates," Proceedings of the American Society of Civil Engineers, Journal of the Structural Division, November, 1970.

PRIOR ART—DISCUSSION

Overhead doors are used for a variety of applications, from refrigerated area closures to light aircraft hangar doors. Design requirements include thermal insulation, structural resistance to lateral loads, such as pressure induced by wind, and security requirements. Among the most common uses are residential and commercial garage closures.

Existing overhead door designs are herein classified into two general categories: (a) single and dual panel designs and (b) designs primarily comprised of a plurality of panels or slats which are connected by hinge mechanisms. General category (a) is further refined to include: (a1) rigid panel designs, (a2) flexible single sheet panel designs and (a3) flexible multi-layer panel designs. General category (b) is also further refined: (b1) rollup designs where, in the open configuration, the panels are rolled onto a horizontal cylindrical mandrel and (b2) track supported designs where, in the open configuration, the panels are supported by tracks.

Due to the large number of overhead door designs, only representative examples of the design categories are discussed below.

(a1) U.S. Pat. No. 4,294,055, describing a single panel door, is included within the rigid panel design category. This design has a relatively large strength-to-weight ratio due to its utilization of a sandwich design consisting of thin interior and exterior sheets bonded to a metallic honeycomb core. The open-close mechanism consists of a relatively complicated strut and spring design. U.S. patent application 20150376933 also describes a single rigid panel design where the door structure is a heavy stiffened frame requiring the use of rams in the open-close mechanisms. Finally, U.S. Pat. No. 4,545,417 depicts a horizontally hinged two-panel rigid door whose weight is counterbalanced by a complicated cable-weight-pulley system. All of the designs in this category are characterized by relatively heavy—to very heavy structures requiring complicated open-close mechanisms. An additional disadvantage of this design category is the clearance space required during open-close operations.

(a2) U.S. Pat. No. 7,231,953 discloses a rollup design within the single flexible panel design category. The door consists of single flexible thin sheet, reinforced by attached horizontal bars. The complete assembly is rolled onto a cylindrical mandrel upon opening. U.S. patent application 20030173040 depicts a similar basic design (single flexible sheet with attached horizontal reinforcing bars) with the exception that the door is constrained to follow guide-support tracks, which transition to the horizontal during opening. The primary disadvantages of the single thin sheet designs are lack of transverse thermal insulation and minimal structural resistance to applied transverse loads.

(a3) The flexible multi-layer single panel design category is illustrated by U.S. patent applications 20100132894 and 20160024837. In both designs, the multi-layer panel is utilized primarily for thermal insulation rather than providing structural capability for lateral load resistance. The former panel design consists of two very flexible skins with a non-structural insulating material sandwiched between the skins. The latter panel design consists of a thin structural skin which is bonded to a thicker non-structural insulating material layer. The 2010 application design open-close operation is primarily in a vertical plane, whereas, in the latter application design, the flexible panel is supported and guided by rods which constrain the door to be in a horizontal position when open. Both designs have limited structural capability to resist lateral loads, such as pressures induced by wind.

(b1) Overhead rollup door, multi panel designs are ubiquitous, usually employed where security is a primary design requirement. U.S. Pat. No. 6,883,577 and U.S. patent application 20110265959 depict typical designs in this category. As with most of these designs, the individual panels are compact, having large aspect ratio and bending stiffness. This results in a heavy door design and, due to the large number of panel-to-panel hinge connections, non-optimal weather tightness and thermal insulation.

(b2) Overhead retracted, track supported, plural panel door designs are perhaps the most numerous within the discussed design categories. U.S. patent application 20040099382 and U.S. Pat. No. 4,460,030 present designs where the individual panels are compact with high aspect ratio, similar to those designs in the (b1) category. The former is stowed in the conventional horizontal plane whereas the latter is stowed in an accordion configuration. U.S. patent application 20120318468 and U.S. Pat. Nos. 4,452,293 and 5,555,923 all disclose designs there the individual panels are comprised of a number of rectangular cells, utilized for improved structural capability and thermal insulation. As with category (b1) designs, these designs have, generally, reduced weather tightness. Sandwich plates or shells, comprised of two relatively thin elastic sheets bonded to a core medium, have high lateral load to structure weight ratio and stiffness to weight ratio. A door utilizing conventional sandwich design, such as the design disclosed in U.S. Pat. No. 4,294,055, has the disadvantages summarized in category (a1) designs. As discussed in the following paragraph, the cellular panel designs summarized in design category (b2), utilize a sandwich-like design where strength-weight ratio is improved. However these designs retain the non-weather tightness limitation.

Arendts (1969), as summarized in Arendts and Sanders (1970), shows that structures, such as box girder bridges, consisting of two relatively thin elastic sheets connected by a plurality of transverse webs, theoretically and actually behave as sandwich plates with orthogonally differing core transverse shear properties. Such a structural panel may be modified, through hinging the web-sheet connections, so that it is flexible. Overall stiffness and strength of the panel is not significantly reduced by hinging the webs and stability is achieved through proper support of the overall structural system.

SUMMARY

A flexible unitary sandwich-like panel overhead door consists of two relatively thin elastic sheets connected by a plurality of elongated parallel web panels. These connections are hinged so that the panel may be flexibly moved from a closed vertical position to an open overhead nearly horizontal configuration. Stability and strength of the panel are achieved through proper internal and external support of the door structure.

Advantages

This flexible unitary sandwich-like panel door has the following advantages when compared with other existing door system designs:

(a) Very large allowable transverse load to structural weight ratio, (b) Very large lateral stiffness to structural weight ratio, (c) Weather tightness, (d) Ability to provide closure for pressure boundaries, (e) Excellent transverse heat insulation due to constrained air in the panel void spaces, (f) Ability to quietly transition the door between closed and open configurations.

DRAWINGS—FIGURES

In the drawings, closely related figures have the same number but differing alphabetical suffixes.

Figure 1:
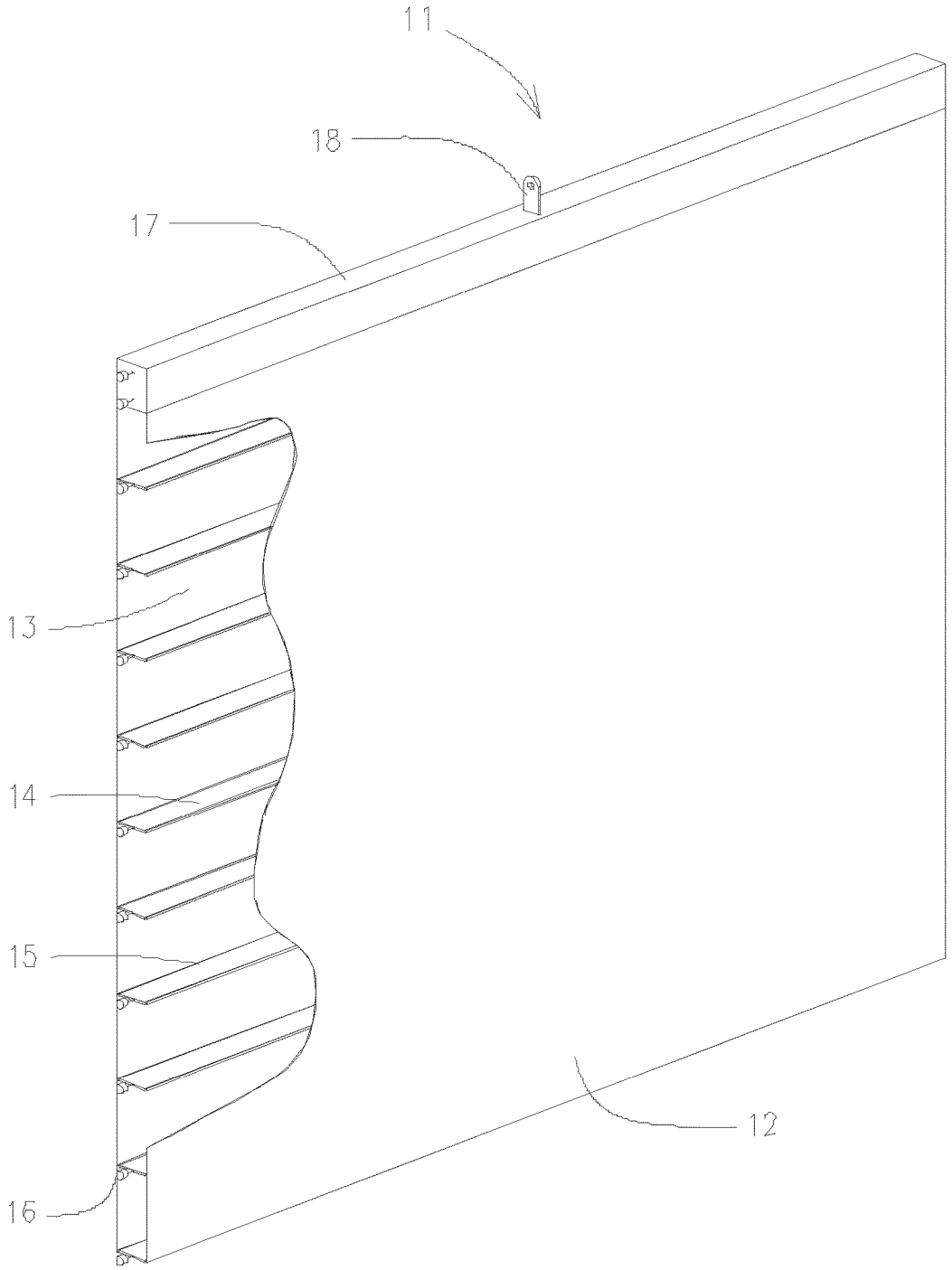
FIG. 1 illustrates a cutaway view of the first embodiment basic elements and detail of the flexible panel door in the closed configuration.

| Drawings - Reference Numerals | |
|---|---|
| 11 | first embodiment door assembly |
| 12 | inner elastic sheet |
| 13 | outer elastic sheet |
| 14 | typical web |
| 15 | typical hinge |
| 16 | typical support roller |
| 17 | first and second embodiment box-beam |
| 18 | open-close mechanism attachment |
| 21 | left support track |
| 22 | right support track |
| 31 | support track bend angle |
| 32 | elastic sheet bend radius |
| 33 | typical web spacing arc length |
| 34 | typical inner sheet chord length |
| 35 | typical outer sheet chord length |
| 61 | second embodiment web angle |
| 62 | second embodiment base |
| 71 | third embodiment box-beam |
| 72 | cam roller guide track centerline |
| 73 | support roller track centerline |
| 74 | support track radius |
| 75 | cam track initial radius |
| 76 | cam track constant radius |
| 77 | transition angle |
| 78 | cam roller |
| 81 | cross-section location designation |
| 91 | support - cam track assembly |

EMBODIMENT DETAILED DESCRIPTIONS

Figure 2A:
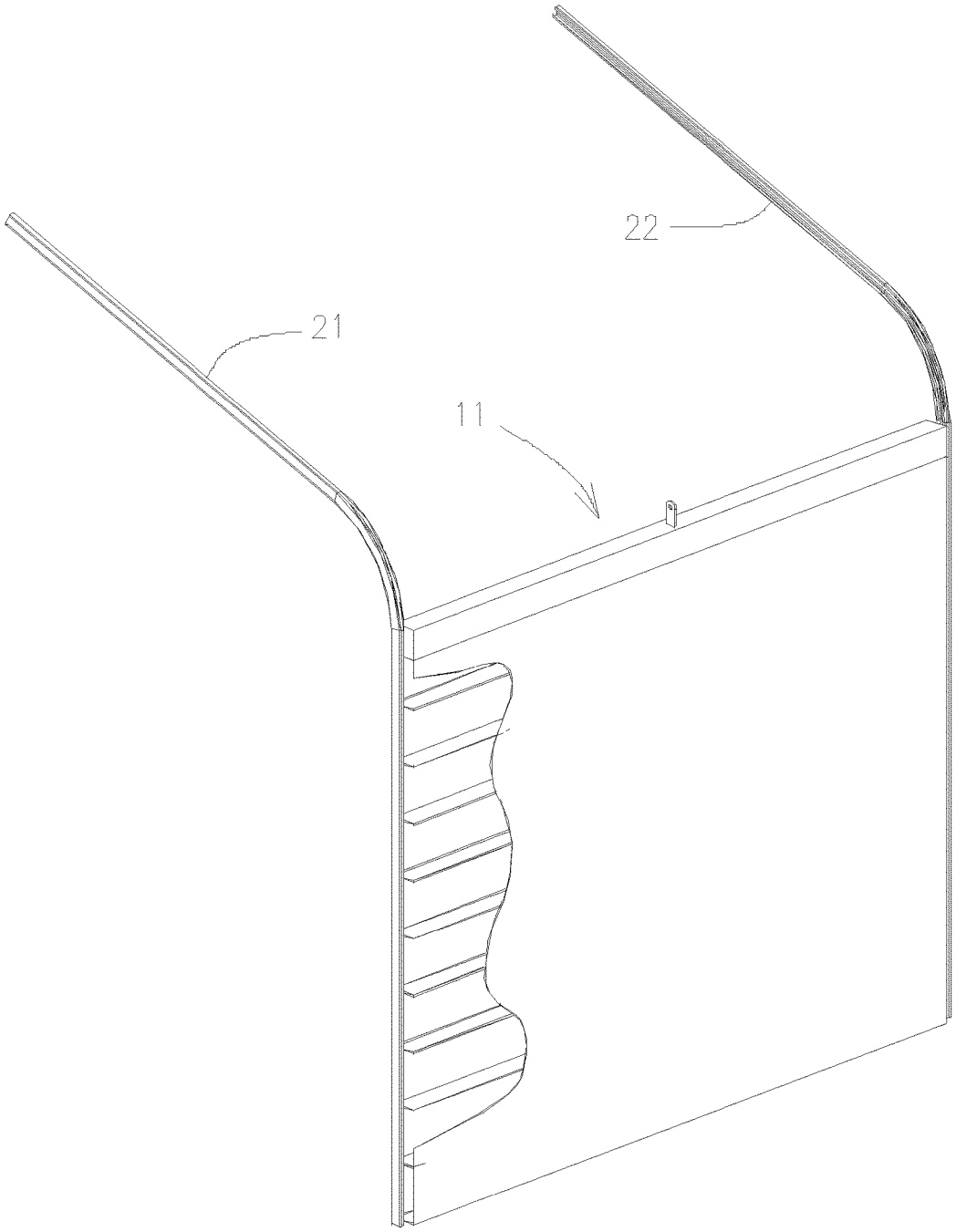
FIGS. 2A through 2C show cutaway views of the door, together with support tracks, in closed, partially open and fully open configurations, respectively.
Figure 2B:
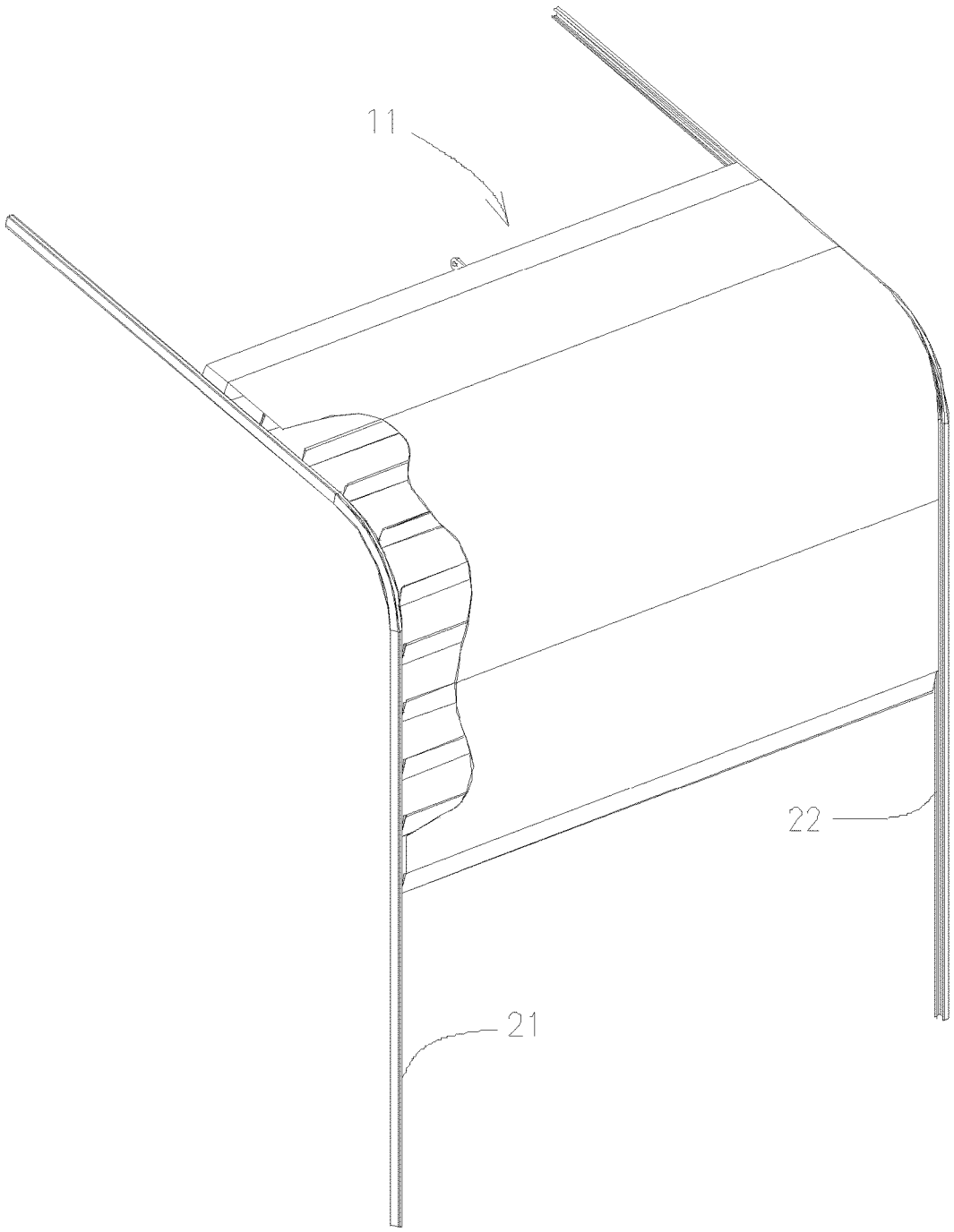
Figure 2C:
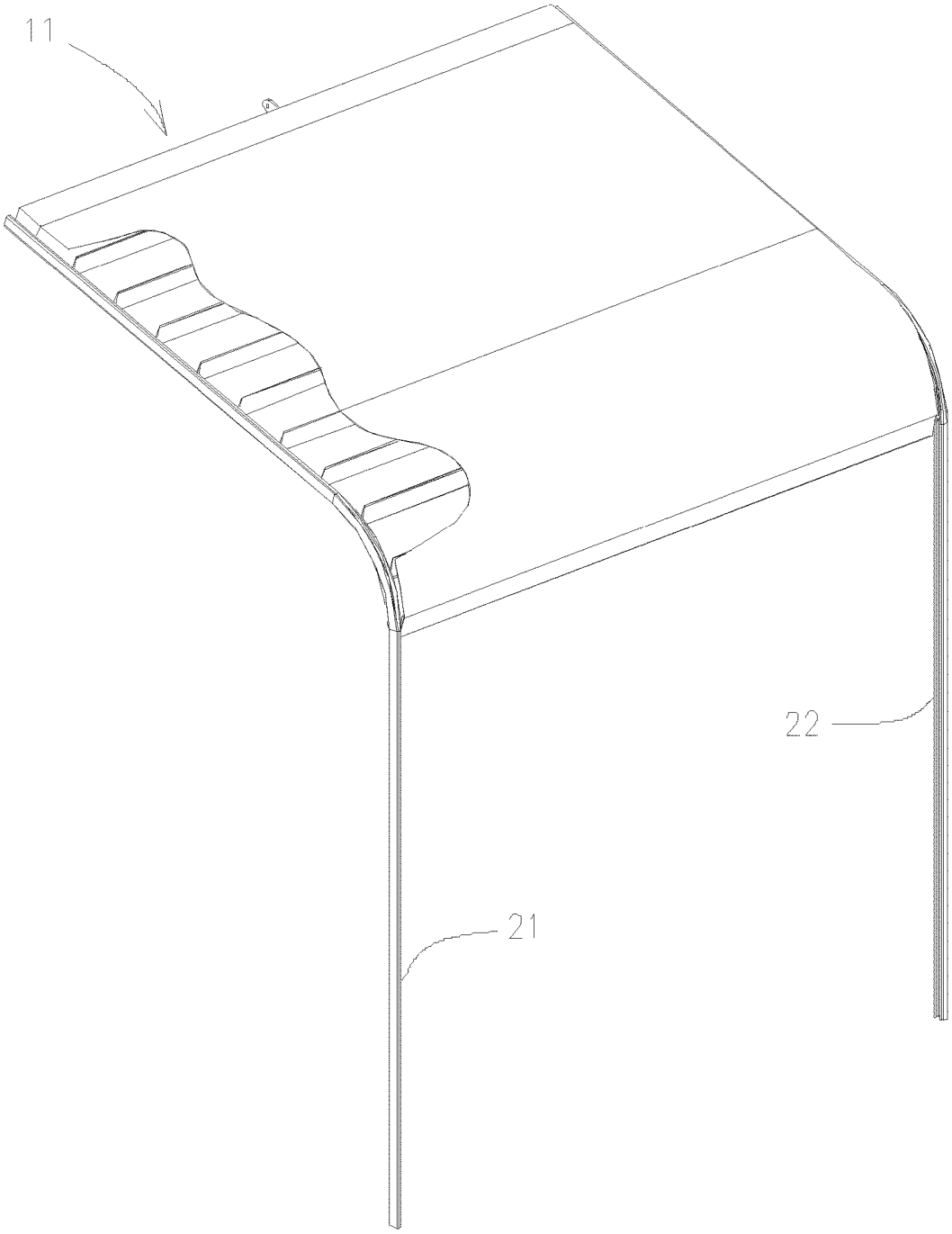

First Embodiment—Overall—FIGS. 1 Through 2C

This embodiment is illustrated in FIG. 1 showing a cutaway view the entire assembly 11. An inner elastic sheet 12 is connected to an outer elastic sheet 13 by a plurality of identical high aspect ratio webs 14 by means of hinges 15. The upper edges of both elastic sheets are rigidly connected to a beam 17 which is integral with an open-close mechanism attachment 18. Support rollers 16 are attached to all of the web 14 ends, as well as the beam 17 ends.

Note that two support rollers 16 are provided at each end of beam 17 so as to prevent axial rotation of the beam with respect to the door supports. This is important for maintenance of strength and stiffness of the door: overall door bending strength about an in-plane horizontal axis is dependent on limiting relative vertical motion of the inner and outer sheets, 12 and 13. Also important for limiting this relative motion are relatively large torsional and flexural beam 17 stiffnesses: a beam with hollow closed rectangular cross-section (box-beam) is optimal for this usage. An extruded high strength metallic material or fiber reinforced polymer (FRP) could be used to construct the box-beam.

The elastic sheets, 12 and 13, could be comprised of homogenous metallic material or of composite construction (FRP). The webs, 14, are subject to only in-plane stresses due to bending stress relief of the hinges, and may thus be constructed of light homogeneous materials or a FRP wrapped core. The hinges, 15, could be conventional mechanical hinges or constructed of flexible polymer composite. Various methods may be employed for hinge attachment to sheets and webs, including mechanical (rivets or spot welds) or adhesives. Also, the webs may be designed to include the hinge elements so that the only attachments required are web-to-sheets.

Operation of the first embodiment door is shown in the cutaway views depicted in FIGS. 2A through 2C where support tracks 21 and 22 are included. These tracks may be the "C" cross-section galvanized steel tracks commonly used for overhead door support applications. Not shown is an open-close mechanism, which may be a conventional screw or cable-chain opener, connected to the open-close mechanism attachment 18.

First Embodiment—Design Considerations—FIGS. 3A Through 5B

Figure 3A:
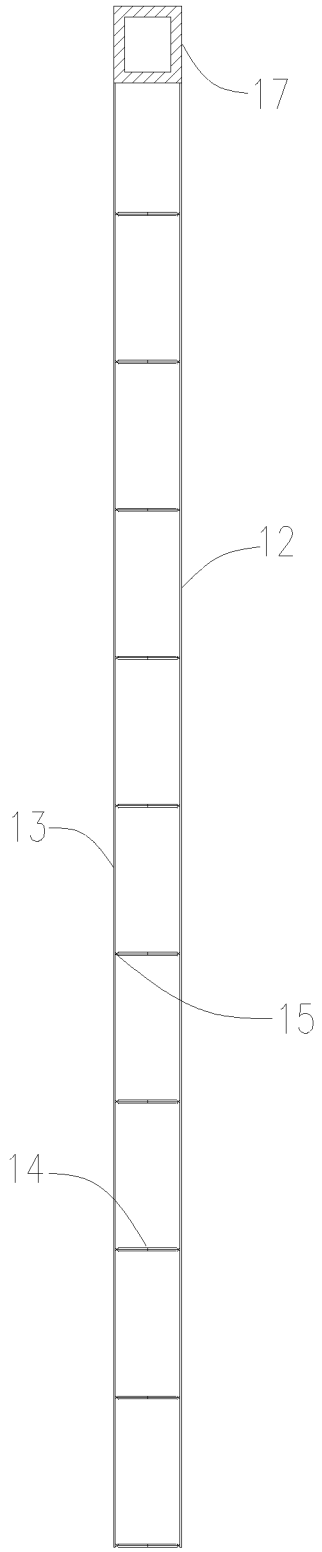
FIGS. 3A through 3C illustrate vertical cross-sections of the door assembly in closed, partially open and fully open configurations, respectively.
Figure 3B:
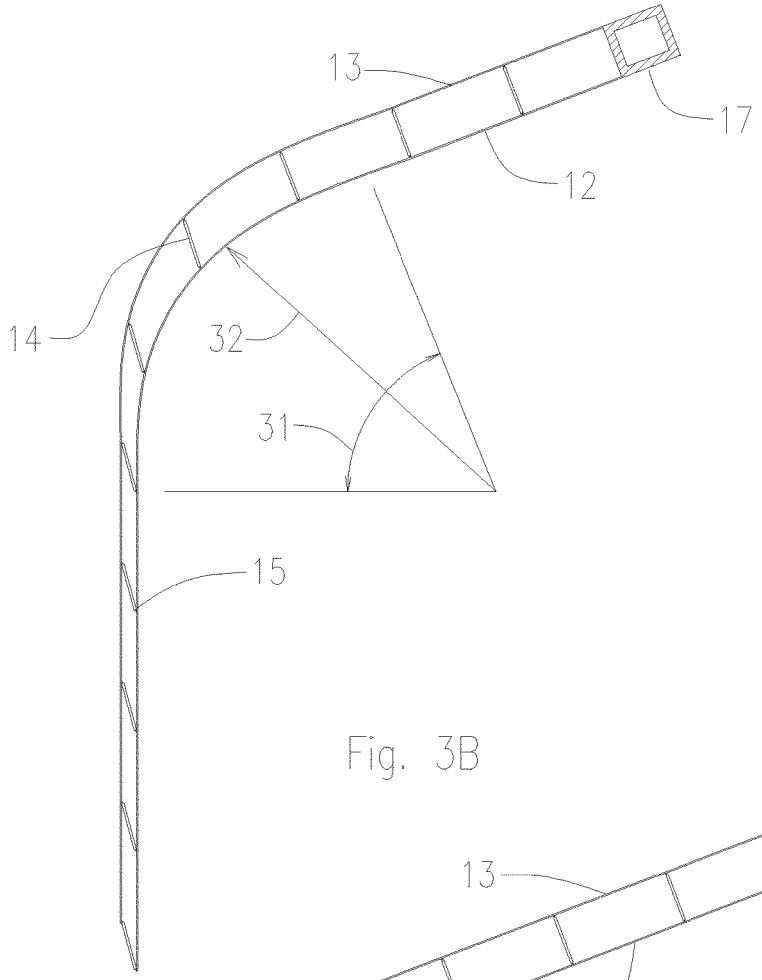
Figure 3C:
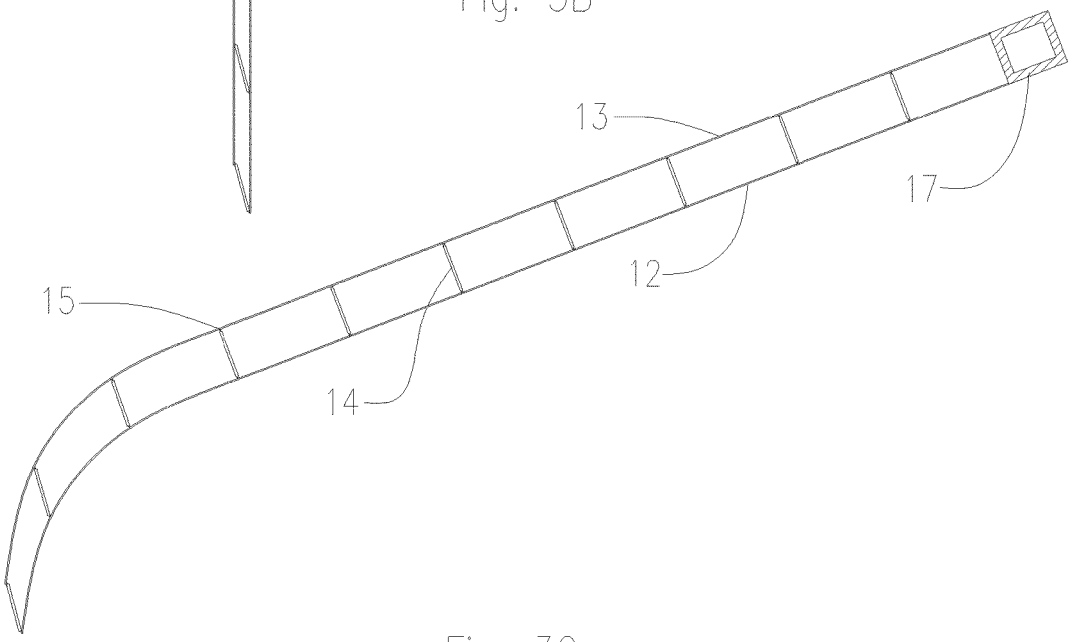

FIGS. 3A through 3C show vertical cross-sections of this embodiment for the closed, partially open and fully open configurations, respectively. A requirement of this embodiment is that the maximum strains in the sheets, 12 and 13, remain within an elastic design criterion of the material comprising the sheets when the embodiment is in the partially open or fully open configurations when the sheets are bent during travel through the curved portion of the support tracks. For metallic materials, an appropriate design strain is 80 percent of the material yield strain or the endurance limit strain. For FRP materials subject to prolonged strain, an appropriate design strain is the creep-rupture limit which varies from 20 to 50 percent of the ultimate rupture strain, depending on the type of fiber used in the design.

Maximum strain, emax, in a cylindrically bent elastic sheet is given by the following well known relationship:

$$e\max = t/(2R),$$

where t is the thickness and R (32) is a typical radius of curvature of the bent sheet. From this relationship, a design t/R ratio is determined by equating emax with the material design strain, as determined in the preceding paragraph.

Figure 3D:
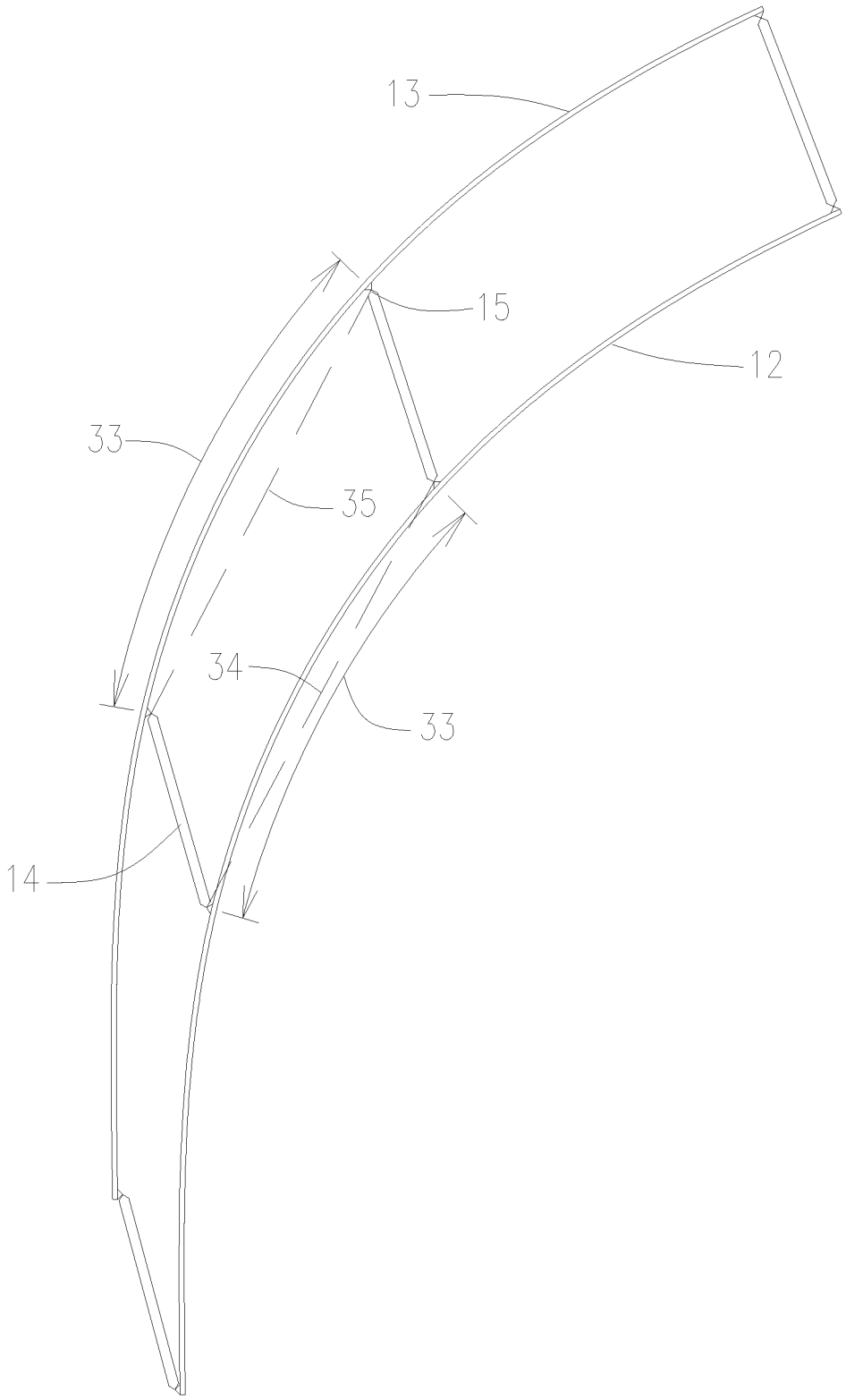
FIG. 3D shows a detail view of a portion of the partially open configuration cross-section.

It is noted from the cross-sections (FIGS. 3A through 3C) that the webs 14 remain approximately parallel to the surface of beam 17 to which the sheets 12 and 13 are attached. However, due to geometric and structural deformation effects in the section where the sheets are curved, the webs are progressively rotated toward the vertical plane. FIG. 3D shows an enlarged detail of the partially opened door cross-section. Since the arc lengths 33 are equal, the chord lengths 34 and 35 differ due to the larger radius of curvature of sheet 13 when compared to the curvature of sheet 12. Also, the distance difference between the hinge 15 centers of rotation and the elastic sheet mid-planes provides a geometric contribution to the web rotation effect.

The net result of this web rotation effect is that the maximum allowable support track rotation angle 31 (FIG. 3B) is less than 90 degrees. Numerical simulations show that, for typical embodiment geometries and materials, the maximum angle is approximately 70 degrees.

Figure 4A:
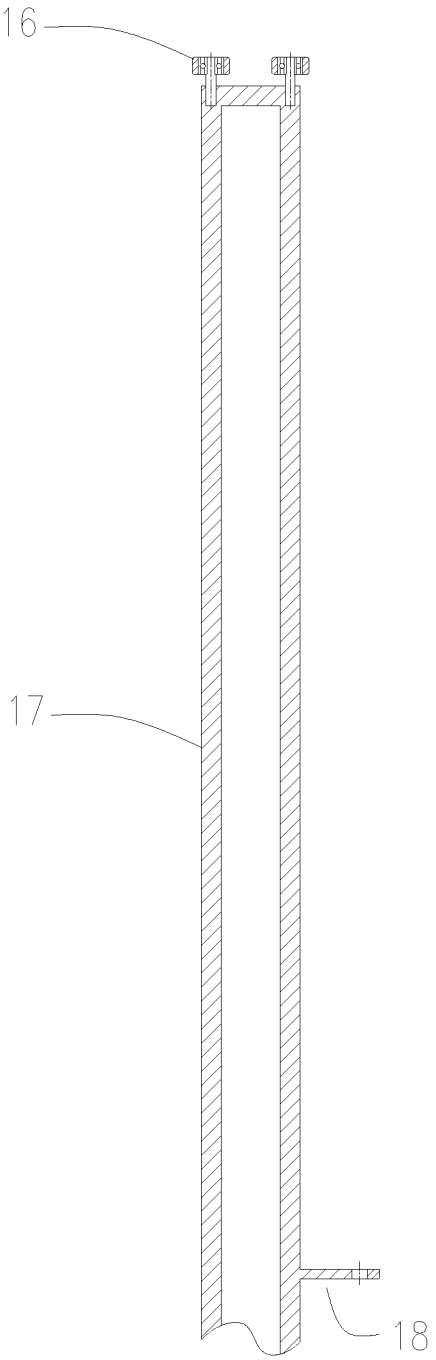
FIGS. 4A and 4B show a vertical cross-section, and plan and elevation views of the first and second embodiment box-beam, respectively.
Figure 4B:
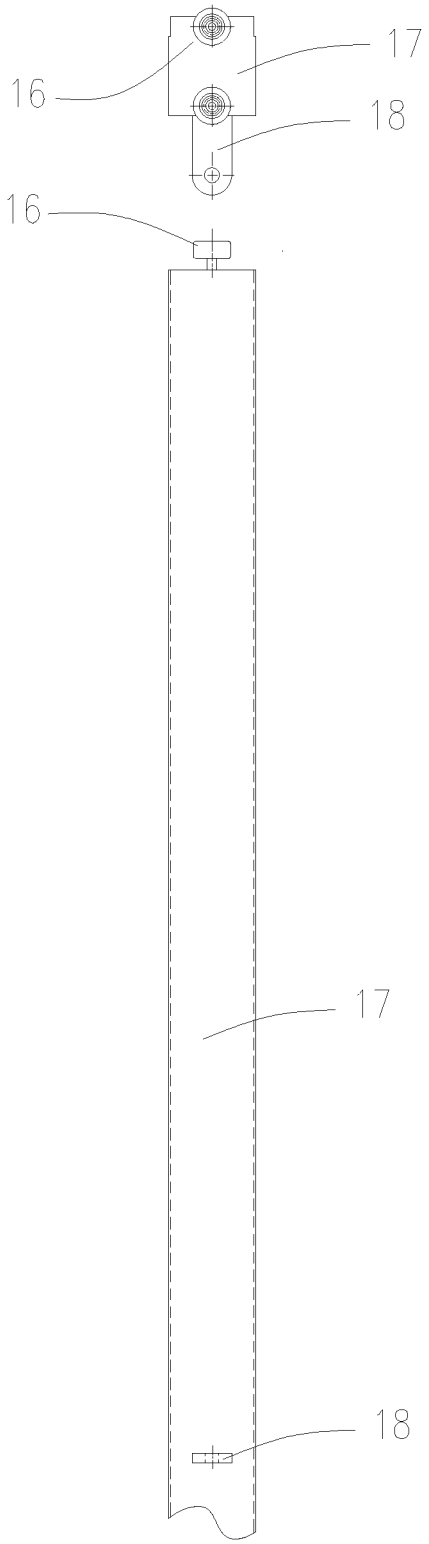

FIGS. 4A and 4B depict a box-beam design where FIG. 4A is a partial vertical cross-section through the beam center and FIG. 4B is an end view and partial plan view of the beam.

Figure 5A:
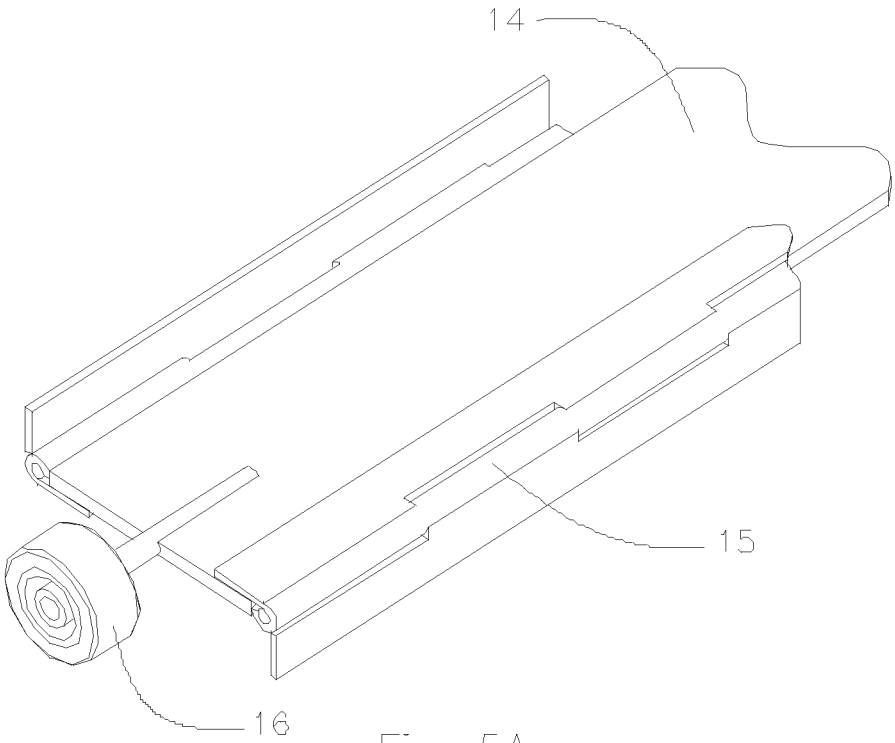
FIGS. 5A and 5B illustrate support roller-web-hinge, and support roller-track detail views, respectively.
Figure 5B:
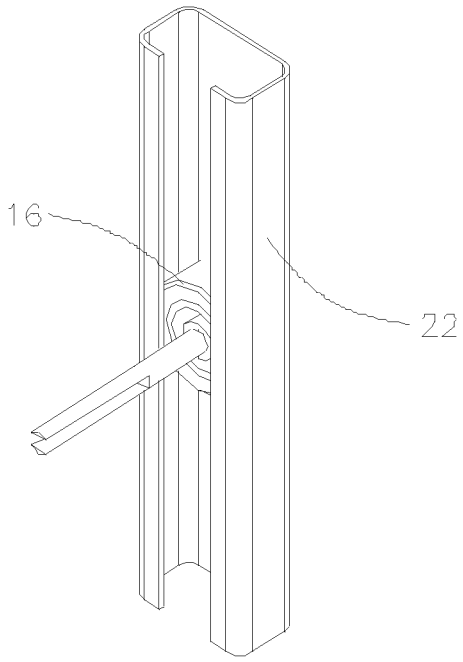

FIGS. 5A and 5B show design details of a web-roller-hinge, and a roller-support track interface, respectively. Note that these drawings are representative of possible design details; other designs utilizing other hinge types, web geometries and roller-web connections are not precluded.

First Embodiment—Construction and Operation

Construction methods required for production of this door embodiment are extremely simple, especially when adhesives are utilized for hinge attachments. For the manufacture of an adhesive bonded planar part of the embodiment, web elements, together with attached support rollers and hinges, are premanufactured. Then, a single elastic face sheet is placed on a horizontal surface, web assemblies and adhesive positioned on the sheet, and the other face sheet placed on this subassembly. Finally, pressure and/or heat is applied to the final assembly, as required for adhesive curing.

Construction of a planar part of the embodiment utilizing mechanical hinge attachment methods is somewhat more complicated. In this case, after pre-manufacture of the web-roller-hinge elements, both sheets may be elastically bent so as to more easily allow mechanical attachment of the webs to the sheets.

After manufacture of the planar portion of the embodiment, relative in-plane motion of the sheets then allows the sheets to separate, and the box-beam to sheet attachments to be made. Additional nonessential parts (not shown in the drawings) such as a floor contact wear strip and seal may be easily attached to this embodiment.

Operation of the embodiment is identical to the majority of track supported and guided overhead doors (category b2 doors discussed above): conventional support tracks and a commercially available powered open-close mechanism are utilized

Additional Embodiments—FIGS. 6A Through 9

For those applications where the elevation of an adjacent ceiling or roof truss is only slightly greater than the door height (limited clearance applications), two additional embodiments are presented in which the support track bend angle 31 is increased to 90 degrees.

Figure 6A:
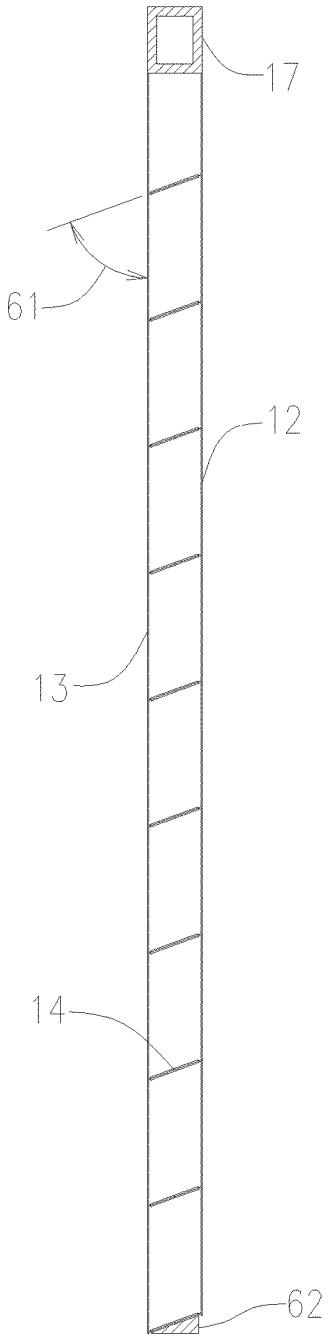
FIGS. 6A through 6C show cross-sections of the second embodiment door in closed, partially open and fully open configurations, respectively.
Figure 6B:
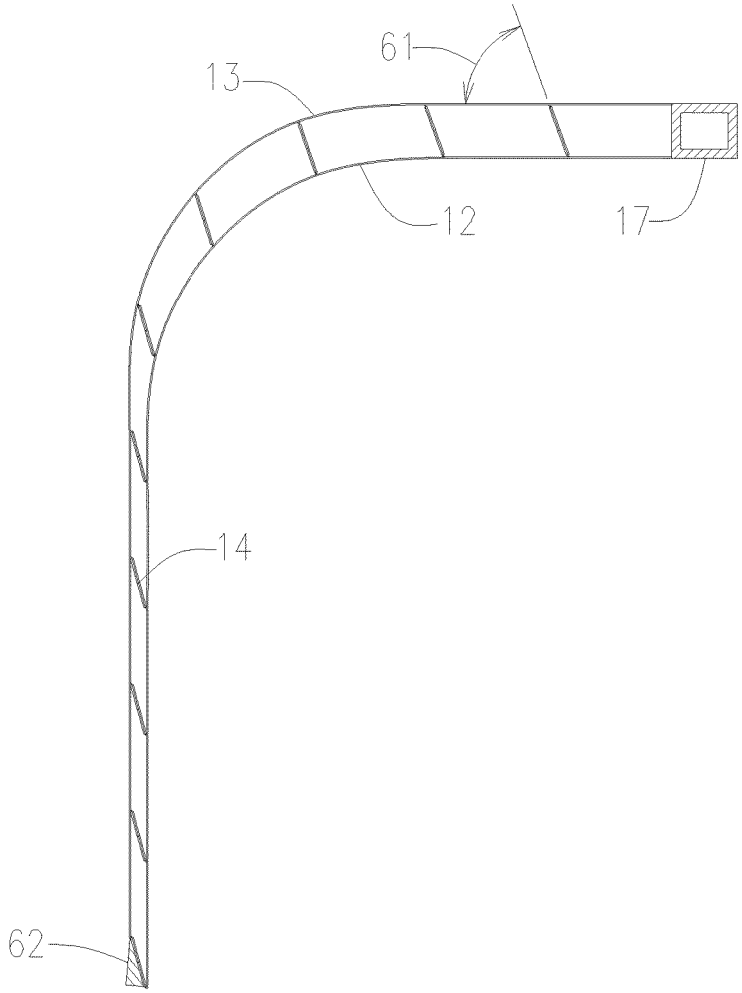
Figure 6C:
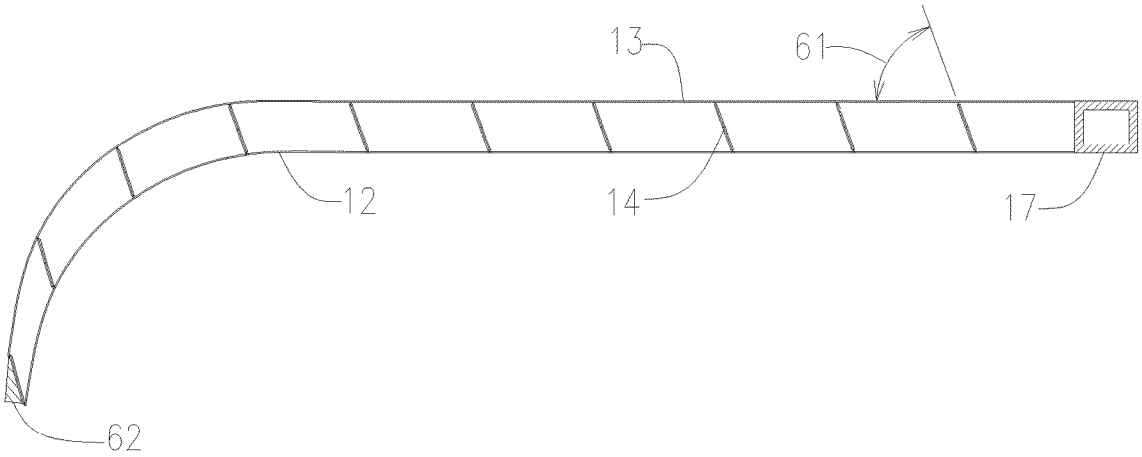

Second embodiment cross-sections are shown in FIGS. 6A through 6C for closed, partially open and fully open configurations, respectively. Required web rotation is provided through provision of an initial web rotation angle 61 to all of the webs during manufacture. As in the case of the first embodiment support track bend angle 31, the magnitude of the required angle 61 is a function of design material properties geometry details. Again, as in the case of angle 31, numerical simulations show that, for typical embodiment geometries and materials, an appropriate value for this angle is approximately 70 degrees.

Also shown in FIGS. 6A through 6C is a base 62, included for distribution of base reaction forces. Except for the items discussed, the second embodiment design is identical to the first embodiment design.

It is noted that for a given web width (or embodiment unit weight), the overall bending strength and stiffness of the second embodiment are somewhat less than corresponding first embodiment characteristics.

Figure 7A:
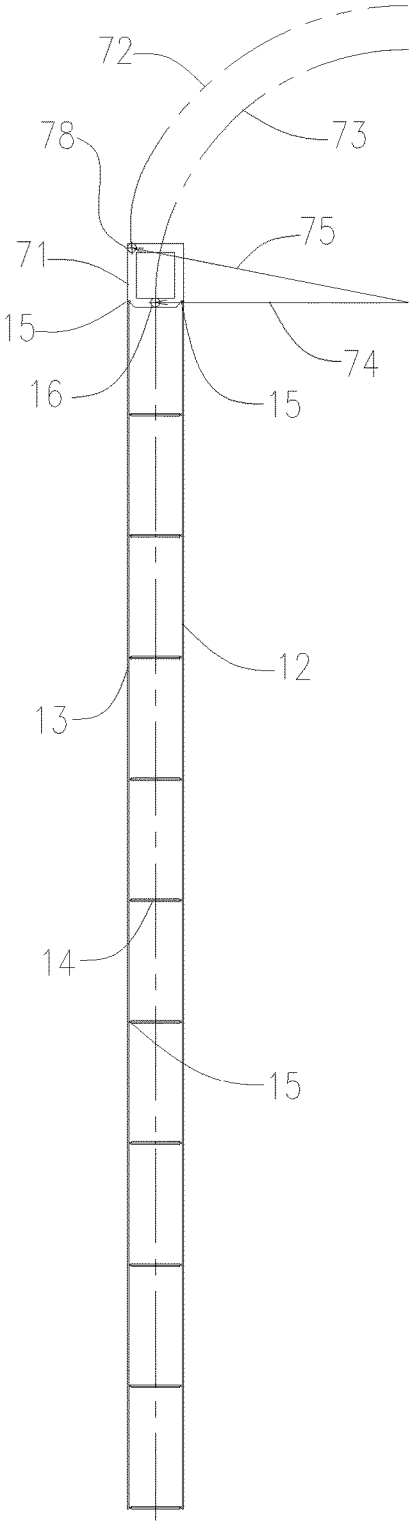
FIGS. 7A through 7C illustrate cross-sections of the third embodiment door in closed, partially open and fully open configurations, respectively.
Figure 7B:
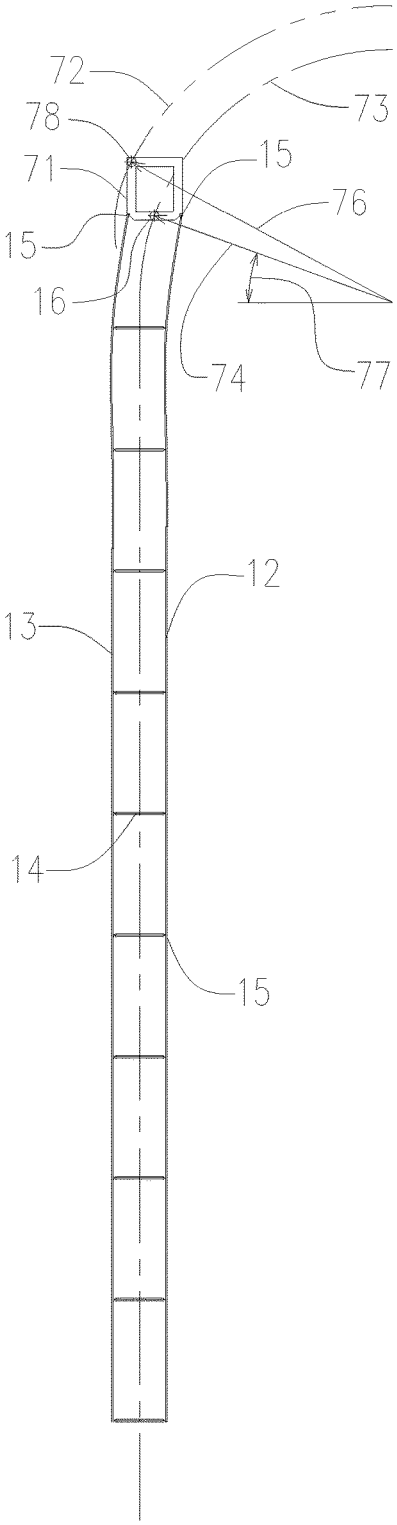

A third embodiment presents an alternate design where the bend angle 31 is increased to 90 degrees with similar bending strength and stiffness as the first embodiment corresponding properties. FIGS. 7A and 7B illustrate cross-sections of the third embodiment for closed and partially open configurations. It is seen that basic web and sheet geometry is the same as for the first embodiment with modifications to the box-beam, track, and beam-sheet connections.

A cam mechanism causes a purely translational motion of the third embodiment box-beam 71 when the beam support rollers 16 follow the initial portion of the support track curve centerlines 73 (embodiment motion between FIG. 7A and FIG. 7B positions). This is accomplished by providing the beam 71 with cam rollers 78 which follow cam track centerlines 72. Note that the cam track centerline radius continuously varies from an initial value 75 (closed condition) to a final value 76 (FIG. 7B position defined by the transition angle 77). The support track radius 74 remains constant throughout the curved portion of the track. Also note that transition angle 77 is greater than the compliment of the first embodiment bend angle 31 (greater than approximately 20 degrees).

Figure 7C:
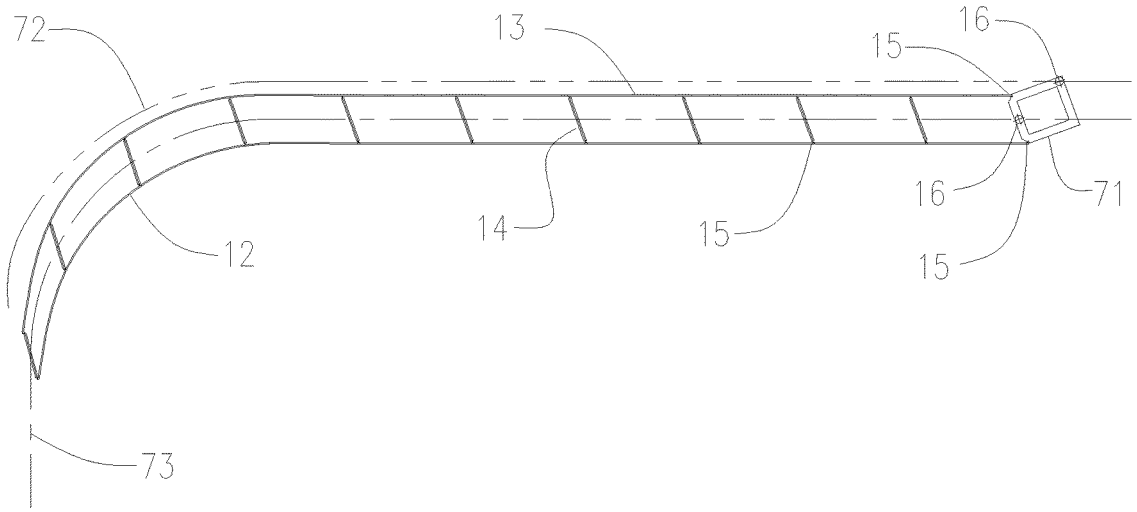

FIG. 7C shows a cross-section of the third embodiment in the fully open configuration. It is observed that support track-cam track spacing remains constant for all locations except for the transition region. It is also seen that the sheet-box-beam connections are hinged rather than rigid as used for the first and second embodiment designs.

Figure 8A:
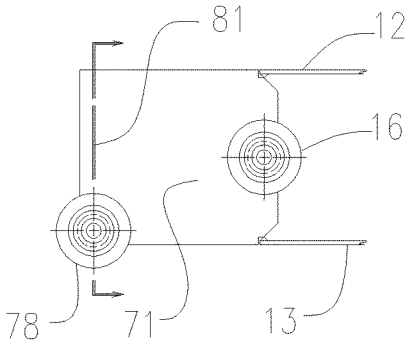
FIGS. 8A through 8C show detail end view, bottom view and a cross-section, respectively, of the third embodiment box-beam.
Figure 8B:
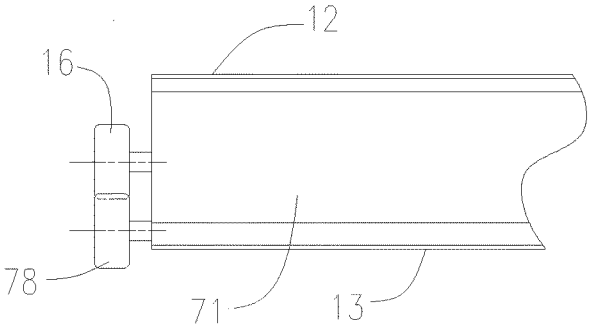
Figure 8C:
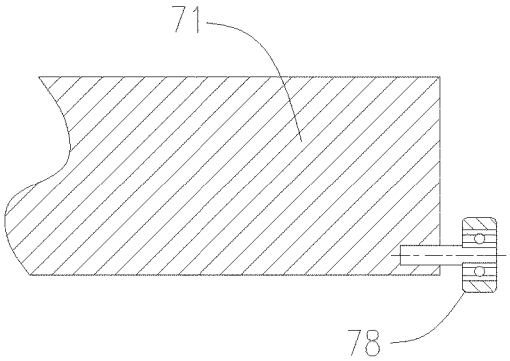

FIGS. 8A and 8B illustrate end and partial bottom views of the third embodiment box-beam, support and cam rollers, and adjacent connected inner and outer sheets. FIG. 8C shows a partial cross-section 81 view, including a cam roller 78.

Figure 9:
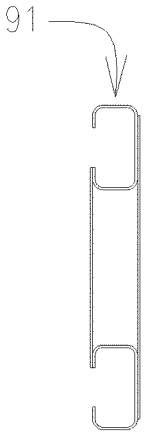
FIG. 9 illustrates a cross-section of the third embodiment composite track assembly.

FIG. 9 shows a cross-section of the combined support and cam track assembly 91.

Embodiments—Advantages

A number of advantages are evident in the embodiments described above:

(a) Very high stiffness and strength to weight ratios of the closed configurations enable light weight embodiments to carry large environmental transverse loads, such as those induced by rain and wind.

(b) Embodiment seamless surfaces enable the closed embodiments to be weather tight and capable of forming static pressure boundaries.

(c) Air confined in the cells of the closed configurations enables natural insulation of transverse heat transfer in the embodiments.

(d) Embodiment construction is extremely easy with no requirements for use of specialized equipment.

(e) Embodiment installation and operation utilizes existing commercially available equipment.

CONCLUSION, RAMIFICATIONS AND SCOPE

A flexible unitary sandwich-like panel overhead door design has been disclosed. This design is simple in concept and construction, yet has many potential uses which take advantage of this design's unique capabilities:

- in its closed configuration, it has a very large stiffness to weight ratio which enables applications requiring low weight, deformations and flutter;
- in its closed configuration, it has a very high lateral load strength to weight ratio which enables applications requiring low weight and high resistance to lateral environmental loading;
- in its closed configuration, it has good natural insulation to transverse heat flow due to air confined in the internal cells of the shell;
- in its closed configuration, it is weather tight and capable, with proper edge sealing, of forming a differential pressure boundary such as could be used in an ultra-clean environment; and
- it is capable of very quiet operation.

Although the above discussion contains many specificities, these should not be construed as limiting the scope of the embodiments, but as merely providing illustrations of some of several possible applications. Thus the scope of the embodiments should be determined by the appended claims and their legal equivalents, rather than by the examples given.

I claim:

1. A flexible panel door, comprising:

a first elastic sheet (12), a second elastic sheet (13) substantially opposite and parallel to said first elastic sheet, a plurality of elongated hinges (15), a plurality of substantially rigid elongated webs (14), each having at least two parallel elongated edges, and each of which is attached in a parallel manner, by a respective one of said hinges along respective said elongated edges, to said first and second elastic sheets, planes of said webs being initially at a 90 degree angle to said elastic sheets, thus sandwiching said webs between said elastic sheets, a rectangular beam (17) which is connected to respective edges of said first elastic sheet (12) and said second elastic sheet (13), said respective edges being parallel to said webs and on opposing sides of said first elastic sheet and said second elastic sheet, a plurality of support rollers (16), each of said rollers attached to a respective end of a respective said web or a respective end of the said beam, a means of support (21) (22) of said rollers (16) so that transverse, at 90 degree angles to said elastic sheets, motion of the ends of said webs and said beam, and axial rotation of said beam, are prevented whereby said means of support enables said beam to be urged so as to elastically transition said flexible panel door from a closed vertical configuration to an open nearly horizontal configuration, or from said open configuration to said closed configuration.

2. The flexible panel door of claim 1 wherein said first and second elastic sheets each have a thickness dimension much less than their other dimensions thus allowing said elastic sheets to remain in an elastic state while being transitioned from said closed configuration to said open configuration and vice versa.

3. The flexible panel door of claim 2 wherein said first and second elastic sheets are composed of either metal or fiber reinforced polymer.

4. The flexible panel door of claim 1 wherein said webs are constructed either homogeneously or of sandwich core material with surface layers of fiber reinforced polymer.

5. The flexible panel door of claim 1 wherein said hinges are constructed in a metallic plate-to-pin-to-plate manner or of flexible fiber reinforced polymer.

6. The flexible panel door of claim 5 wherein said hinges are attached to said webs and said first and second elastic sheets by mechanical fasteners or adhesive.

7. The flexible panel door of claim 5 wherein said hinges are constructed integrally with said webs.

8. The flexible panel door of claim 7 wherein said integral web hinges are attached to said first and second elastic sheets by mechanical fasteners or adhesive.

9. A flexible panel door, comprising:

a first elastic sheet (12), a second elastic sheet (13) substantially parallel to said first elastic sheet, a plurality of elongated hinges (15), a plurality of substantially rigid elongated webs (14), each having at least two parallel elongated edges, and each of which is attached in a parallel manner, by a respective one of said hinges along respective said elongated edges, to said first and second elastic sheets, planes of said webs being initially at an angle (61) to said elastic sheets, thus sandwiching said webs between said elastic sheets, a rectangular beam (17) which is connected to respective edges of said first elastic sheet (12) and said second elastic sheet (13), said respective edges being parallel to said webs and on opposing sides of said first elastic sheet and said second elastic sheet, a plurality of support rollers (16), attached to ends of said webs and said beam, g. a means of support (21) (22) of said rollers (16) so that transverse, at 90 degree angles to said elastic sheets, motion of the ends of said webs and said beam, and axial rotation of said beam are prevented, whereby said means of support enables said beam to be urged so as to elastically transition said flexible panel door from a closed vertical configuration to an open horizontal configuration, or from said open configuration to said closed configuration.

10. The flexible panel door of claim 9 wherein said first and second elastic sheets each have a thickness dimension much less than their other dimensions thus allowing said elastic sheets to remain in an elastic state while being transitioned from said closed configuration to said open configuration and vice versa.

11. The flexible panel door of claim 10 wherein said first and second elastic sheets are composed of either metal or fiber reinforced polymer.

12. The flexible panel door of claim 9 wherein said webs are constructed either homogeneously or of sandwich core material with surface layers of fiber reinforced polymer.

13. The flexible panel door of claim 9 wherein said hinges are constructed in a metallic plate-to-pin-to-plate manner or of flexible fiber reinforced polymer.

14. The flexible panel door of claim 13 wherein said hinges are attached to said webs and said first and second elastic sheets by mechanical fasteners or adhesive.

15. The flexible panel door of claim 13 wherein said hinges are constructed integrally with said webs.

16. The flexible panel door of claim 15 wherein said integral web hinges are attached to said first and second elastic sheets by mechanical fasteners or adhesive.

* * * * *